United States Patent [19]

Irie et al.

[11] 3,930,906

[45] Jan. 6, 1976

[54] METHOD FOR FORMING AN INSULATING GLASS FILM ON A GRAIN-ORIENTED SILICON STEEL SHEET HAVING A HIGH MAGNETIC INDUCTION

[75] Inventors: Toshio Irie, Kobe; Yasuo Yokoyama, Ashiya; Toshitomo Sugiyama, Kobe; Hiroshi Shimanaka, Funabashi; Shigeru Kobayashi, Chiba, all of Japan

[73] Assignee: Kawasaki Steel Corporation, Kobe, Japan

[22] Filed: Feb. 24, 1975

[21] Appl. No.: 552,029

[30] Foreign Application Priority Data

Feb. 28, 1974 Japan ..... 49-22860

[52] U.S. Cl. ..... 148/113; 148/31.5; 148/112; 427/127

[51] Int. Cl.[2] ..... H01F 1/04

[58] Field of Search ..... 148/113, 112, 111, 110, 148/31.55, 31.5; 75/123 L; 427/127

[56] References Cited

UNITED STATES PATENTS

| | | | |
|---|---|---|---|
| 3,632,456 | 1/1972 | Sakakura et al. | 148/111 |
| 3,770,517 | 11/1973 | Gray et al. | 148/111 |
| 3,853,641 | 12/1974 | Sakakura et al. | 148/111 |
| 3,872,704 | 3/1975 | Ohya et al. | 148/111 |

*Primary Examiner*—Walter R. Satterfield

[57] ABSTRACT

An insulating glass film having an excellent uniformity and a high adhesion to a grain-oriented silicon steel sheet having a high magnetic induction is formed by annealing a coil of a cold rolled silicon steel sheet having a final gauge in an annealing furnace under a non-oxidizing and non-reducing neutral inert gas, such as nitrogen or argon at a constant temperature keeping stage of 800°–920°C and then under dry hydrogen at a temperature of 1,000°–1,200°C in the final annealing stage.

6 Claims, 1 Drawing Figure

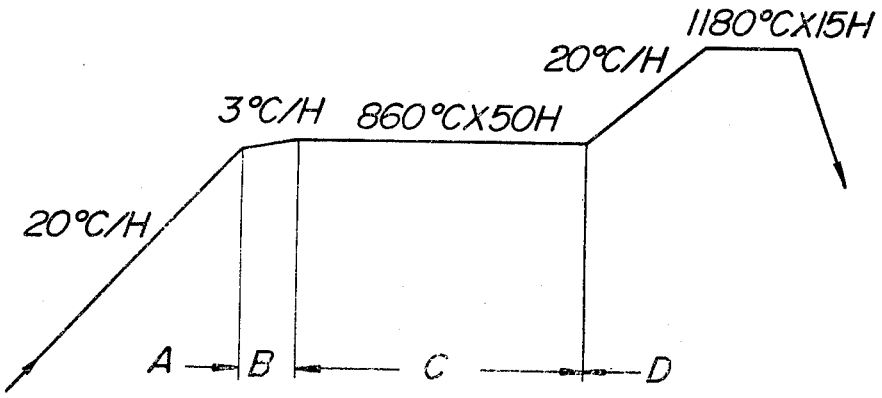
1180°CX15H
20°C/H
3°C/H
860°CX50H
20°C/H
A
B
C
D

METHOD FOR FORMING AN INSULATING GLASS FILM ON A GRAIN-ORIENTED SILICON STEEL SHEET HAVING A HIGH MAGNETIC INDUCTION

The present invention relates to a method for forming $MgO-SiO_2$ insulating glass film on surfaces of a grain-oriented silicon steel sheet having a high magnetic induction.

It has been heretofore known that in the production of grain-oriented silicon steel sheets, the cold rolled silicon steel strips rolled into the final gauge are subjected to a decarburization annealing under an atmosphere composed of hydrogen-steam to form $SiO_2$ and iron oxide on the surfaces of the strip, an annealing separator consisting mainly of Mgo is coated on the resulting oxide layer, then the thus treated strip is wound into a coil and the formed coil is subjected to a final annealing within a temperature range of 1,100°–1,300°C under hydrogen atmosphere to form $MgO-SiO_2$ insulating glass film.

However, for the production of a grain-oriented silicon steel sheet having $B_8$ value of more than 1.85 $WB/m^2$, the above described final annealing is carried out in two stages, the first stage of which is effected by heating the coiled sheet at a temperature of 800°–920°C for 10–100 hours to selectively develop the secondary recrystallized grains having (110) [001] orientation and the second stage of which is effected by keeping the temperature at a temperature of 1,000°–1,200°C to remove impurities remaining in the steel sheet, such as S, Se, N and the like. When such annealing steps are adopted, if the dry hydrogen is used as the annealing atmosphere, the formed $MgO-SiO_2$ glass film is very ununiform and further the adhesion to the silicon steel base metal is low. Particularly, when the thickness of the surface oxide layer composed of $SiO_2$ and iron oxide formed in the decarburization annealing conducted just before the annealing separator is coated, is thin, this tendency becomes noticeable and the whitish colored film having an inferior adhesion is formed in entire or partially on the steel sheet or the part having substantially no film is formed.

In order to restrain the formation of these drawbacks, it is considered that the thickness of the oxide surface layer formed in the decarburization annealing is increased. However, when the formed oxide layer is thick, the resulting $MgO-SiO_2$ glass film becomes thick and consequently the lamination factor is lower.

That is to say, the fact that the oxide layer becomes thick means that the available cross-section of the base metal decreases in proportion to the thickness of the oxide layer and the magnetic properties lower. In the case of the grain-oriented silicon steel sheet having a magnetic induction $B_8$ value of about 1.85 $Wb/m^2$, as the thickness of the oxide layer on one surface increases by 1 $\mu m$, about 0.005 $Wb/m^2$ lowers according to the theoretical calculation but in practice, the decrease of $B_8$ value is much larger than the theoretical value. Particularly, when the grain-oriented silicon steel sheet having a high magnetic induction ($B_8$ value) of more than 1.88 $Wb/m^2$ is produced by fully developing the secondary recrystallized grain within a temperature range of 800°–920°C, if the thickness of the oxide layer increases by about 1 $\mu m$, the magnetic induction lowers by 0.010–0.015 $Wb/m^2$. This is presumably based on the following reason that the grain nuclei present on the surface of the cold rolled steel sheet, from which grain nuclei the secondary recrystallized grains of (110) [001] orientation are developed, are lost by the oxidation. Accordingly, when the secondary recrystallized grains are to be fully developed by maintaining the temperature at 800°–920°C for a long time, it must not be accepted to improve the adhesion of the glass film to the base metal by increasing the thickness of the oxide layer, because the $B_8$ value would be deteriorated.

Furthermore, when the silicon steel raw material contains 0.005–0.20% of Sb, the thickness of the oxide layer formed by the decarburization annealing becomes thin, so that when a grain-oriented silicon steel sheet having a high $B_8$ value is to be produced by fully developing the secondary recrystallized grains of (110) [001] orientation at a temperature of 800°–920°C, preferably 800°–880°C, the good film cannot be formed by box annealing under atmosphere consisting mainly of hydrogen as in the prior art.

The object of the present invention is to provide a method for uniformly forming $MgO-SiO_2$ insulating glass film having a high adhesion to the base metal on the surfaces of the grain-oriented silicon steel sheet having a high magnetic induction, which is formed by developing the secondary recrystallized grains of (110) [001] orientation by annealing at 800°–920°C.

Another object of the present invention is to provide a uniform film having an excellent adhesion to the base metal on the silicon steel sheet containing 0.005–0.20% of Sb and the technical essential points are as follows.

The inventors have made investigations with respect to the annealing atmosphere at the stage where the temperature is maintained constantly at the temperature range of 800°–920°C for several ten hours for fully developing the secondary recrystallized grains having predominantly (110) [001] orientation in the course of the final annealing stage and as the result, the above described problem has been solved by using an inert gas, such as nitrogen or argon as the annealing atmosphere gas whereby the $MgO-SiO_2$ glass film having a high adhesion to the base metal is uniformly formed on the surface of the steel sheet.

Heretofore, it has been recommended that hydrogen or a gas consisting mainly of hydrogen is used as the atmosphere gas of the final annealing of the grain-oriented silicon steel sheet and hydrogen alone or dissociated ammonia gas containing about 75% of hydrogen has been industrially used as the final annealing atmosphere gas. In this process, if the annealing separator is coated and the temperature is raised fairly rapidly, for example, at a rate of 20°C/hour to the secondary recrystallizing temperature of 1,100°–1,200°C from room temperature, it has been able to obtain a product having a satisfactory film.

However, if the annealing atmosphere is only hydrogen, when the secondary recrystallized grains are developed by maintaining a temperature of 800°–920°C for long time in order to obtain the grain-oriented silicon steel sheet having a high magnetic induction, only a considerably ununiform film is obtained.

The inventors have made various studies with respect to the process for forming the glass film and accomplished a method for solving the above described problems.

In the study of the present invention, the oxides formed at the decarburization annealing and $SiO_2$ in the $MgO-SiO_2$ glass film formed at the final annealing at a high temperature have been compared quantitatively and as the result it has been found that when the film having a high adhesion is formed uniformly, the amount of $SiO_2$ in the film substantially coincides with the value that all the oxygen in $SiO_2$ and iron oxide formed in the decarburization annealing is converted into the oxygen constituting $SiO_2$ during the final annealing at a high temperature, while the amount of $SiO_2$ in the whitish film having a low adhesion or in the thin film wherein the grain boundary substantially sees through, is less than the value that all the oxygen given at the decarburization annealing is converted into $SiO_2$. This result shows that when the iron oxide formed at the decarburization annealing oxidizes silicon in the steel sheet into $SiO_2$ at the final annealing at a high temperature by any reaction, for example, by the following formula (1), the film having a good adhesion can be formed, while when the iron oxide is reduced with hydrogen by the following formula (2), the film having a low adhesion is formed.

$$2FeO+Si \rightarrow 2Fe+SiO_2 \quad (1)$$
$$FeO+H_2 \rightarrow Fe+H_2O \quad (2)$$

In general, the final annealing at a high temperature is carried out by winding the steel strip having a width of 700–1,000 mm into a coil of 3–15 tons and immediately raising the temperature to 1,000°–1,200°C at a rate of 15°–30°C/hour and in this case the atmosphere surrounding the coil consists mainly of hydrogen but the pressure of atmosphere between the layers of the tightly wound coil after the powdery magnesia, which directly serves to form the film, is coated, is always higher than the pressure of hydrogen atmosphere surrounding the coil owing to the heat expansion resulting from the temperature raise and steam dissociated from the magnesia coating layer, so that the hydrogen atmosphere introduced into the annealing box difficultly penetrates and diffuses into the coil layers. Accordingly, the iron oxide formed at the decarburization annealing is substantially not reduced by hydrogen and when the temperature reaches higher than about 800°C at which the reaction rate of the above formula (1) becomes larger, $SiO_2$ is formed by the reaction towards the right direction in the formula (1), when the temperature reaches higher than about 1,000°C, the steam no longer evolves from the coated separator and the coated MgO in the separator combines with $SiO_2$ to form MgO-$SiO_2$ glass film, so that the penetration and diffusion of hydrogen into the coil layers become easy but in this stage, the reaction towards the right direction of the formula (1) has been completed and consequently the reaction of the formula (2) does not occur and the formation of the film is not adversely affected.

On the other hand, if the temperature is kept constant within the range of 800°–920°C, the pressure between the coil layers and the pressure at the area surrounding the coil reach equilibrium and the annealing atmosphere easily penetrates and diffuses into the spaces between the coil layers and when hydrogen is used as the annealing atmosphere, the iron oxide formed at the decarburization annealing is reduced according to the formula (2). Furthermore, it has been found that when the adjustment of temperature at the stage where the temperature is kept constant, is not precise, for example, the adjustment is effected by "on-off" system, the coil is repeatedly subjected to slight heating and cooling during the temperature keeping stage and upon the cooling, the penetration of the atmosphere gas in the furnace consisting mainly of hydrogen into the spaces between the coil layers is promoted and the formation of bad film is promoted. The influence of the keeping time at the constant temperature upon the film was searched and the following facts have been found. In the case when the keeping time is not more than 5 hours, the formation of the bad film is not noticeable, but when the keeping time reaches more than 10 hours, the area of the whitish film having a poor adhesion increases and until 50 hours, as the keeping time becomes longer, the degree of the degradation of the film increases.

As mentioned above, when the well known atmosphere consisting mainly of hydrogen is used at the temperature raising stage and the stage where the temperature at 800°–920°C is kept constant, the strong reducing gas penetrates into the space between the coil layers, thereby the direct reduction of FeO mainly occurs due to hydrogen as shown in the above formula (2) and the reduction of FeO by Si in the above formula (1) does not substantially occur and the film having a poor adhesion is formed. According to the present invention, a non-oxidizing and non-reducing atmosphere gas, such as nitrogen or argon, that is an inert neutral atmosphere gas is used in order to avoid this defect. By using such a gas, the reaction of the above formula (1), that is the reaction in which oxygen in FeO is combined with Si to form $SiO_2$, proceeds smoothly and even if the thickness of the oxide layer at the decarburization annealing is thin, the MgO-$SiO_2$ glass film having a high adhesion to the base metal can be uniformly formed.

The inventors have disclosed in Japanese Pat. No. 715,291 a method for adjusting the atmosphere in the annealing furnace, particularly the atmosphere between the coil layers but in the method of the above described patent characterized in that the atmosphere between the coil layers is always maintained in a weak oxidizing condition by steam until raising to the high temperature, the oxidation of the steel sheet proceeds to about 830°C by steam between the layers and the film becomes thick and therefore the lamination factor and the magnetic properties of the product are degraded, so that this process is not applicable to the production of the grain-oriented silicon steel sheet having a high magnetic induction, which is aimed at in the present invention.

The invention will be explained in more detail with reference to the accompanying drawing. The Figure shows a typical heating program of the final annealing of the grain-oriented silicon steel sheet having a high magnetic induction, which is aimed at in the present invention. The heating program can be classified into four heating stages (A, B, C and D) by the heating type A: Heating stage at a high temperature raising rate immediately before the secondary recrystallizing temperature.

B: Gradual heating stage immediately before keeping the constant temperature for the secondary recrystallization.

C: Constant temperature keeping stage for the secondary recrystallization.

D: Purification annealing stage at a higher temperature following to the constant temperature keeping stage.

The properties of MgO-$SiO_2$ glass films of Samples 1–6 obtained by varying the combination of the gases to be used in the stages A-C and using hydrogen gas in any samples in the stage D among the above described stages A-D were determined and the obtained results are shown in the following Table 1.

Table 1

| Sample | Annealing atmosphere A | B | C | D | Appearance of $MgO—SiO_2$ glass film | Minimum bending radius (mm) |
|---|---|---|---|---|---|---|
| 1 | $H_2$ | $H_2$ | $H_2$ | $H_2$ | Uneven film constituting of white gray portion and thin portion where the grain boundary sees through. | 30 |
| 2 | $N_2$ | $H_2$ | $H_2$ | $H_2$ | Ditto | 30 |
| 3 | $N_2$ | $N_2$ | $H_2$ | $H_2$ | Uneven film constituting of white gray portion and thin portion where the grain boundary sees through. Partially deep gray. | 30 |
| 4 | $N_2$ | $N_2$ | $N_2$ | $H_2$ | Entire length is uniform, deep gray. | 10 |
| 5 | $H_2$ | $N_2$ | $N_2$ | $H_2$ | Entire length is uniform, deep gray. | 10 |
| 6 | $H_2$ | $H_2$ | $N_2$ | $H_2$ | Substantially entire surface is deep gray. There is whitish gray film at the outer coiled portion and the edge portion in the width direction. | 15 |

In the above Table, the Sampe Nos. 4, 5 and 6 using the nitrogen gas at the heating stage C show the excellent film appearance and the minimum bending radius which does not cause the exfoliation on the film, is small but particularly, the Sampe Nos. 4 and 5 using the nitrogen gas in the heating stage B are best in the film appearance and the minimum bending radius for forming no exfoliation of the film. Namely, it has been found that if the neutral inert gas, such as nitrogen gas is used as the annealing atmosphere at least at the constant temperature keeping stage is used, the good film can be obtained.

In the present invention, as the atmosphere gas at the original rapid heating stage, use may be made of any gases, if the gases have no oxidizing property and for example, the gas consisting mainly of hydrogen, or nitrogen or argon gas diluted with hydrogen, or pure nitrogen or argon gas. However, as the atmosphere gas at the subsequent constant temperature keeping stage, non-oxidizing and non-reducing inert neutral gas is necessary and as the neutral gas, nitrogen gas is more economic than argon and the like, so that it is advantageous to use nitrogen. The reason why any of the reducing gas and the neutral gas may be used at the rapid heating stage A as mentioned above and as seen from the above Table 1, is based on the fact that the atmosphere between the coil layers is not substantially influenced by the atmosphere gas surrounding the coil at this stage. When MgO which is larger in the hydration amount, is used as the annealing separator and the amount of the gas introduced into the furnace is smaller as compared with the free space when the coil is charged in the annealing furnace, the steam evolved between the coil layers is discharged and the edge portions of the coil width are apt to be oxidized and therefore it is advantageous to make the amount of the gas supplied larger.

In order to avoid the over heating called as "over shoot" immediately before the constant temperature keeping stage, that is the state C, it is preferably to insert the gradual heating stage B but in this stage, since it is necessary to make the temperature raising rate very small, the atmosphere gas surrounding the coil is liable to enter into the spaces between the coil layers and particularly the bad film is apt to be formed in the edge portions of the coil, accordingly, it is advantageous to possibly avoid hydrogen as the gas to be used in the stage B. However, the use of hydrogen is not absolutely in advantageous and as proved by the Sample No. 6 in the above Table 1, the gas may be conveniently used depending upon the temperature raising rate.

At the constant temperature keeping stage C, the atmosphere in the annealing furnace greatly influences upon the atmosphere between the coil layers as mentioned above, so that it is advantageous to use the non-oxidizing and non-reducing gas, that is a neutral gas, such as nitrogen or argon. However, it is not always necessary to use highly pure nitrogen or argon and even if these gases contain a very small amount of about 100 ppm of oxygen and the like, a great drawback is not caused.

When the secondary recrystallization is substantially completed in the texture after keeping the constant temperature for a given time, the purification annealing for removing the impurity in the steel, such as nitrogen and the primary recrystallization inhibitor, such as Se, S and the like, is effected. In the purification annealing stage D, the coil is kept at 1,100°–1,200°C in hydrogen atmosphere for more than several hours. Accordingly, after the constant temperature keeping stage C, the neutral gas used until said stage must be replaced with hydrogen. But, it is not necessary to carry out distinctly this replacement immediately after the completion of the stage C but when the temperature at which nitrogen is replaced with hydrogen, is higher than 950°C and the $FeO-SiO_2$ glass film formed at the decarburization annealing stage is more than about 3 $\mu$, glossy spots having a diameter of 0.1–2 mm where the film is lacked, are formed in the edge portions of the coil and the outer coiled portion and the spot portions are poor in the insulating resistance, so that the replacement to hydrogen must be effected at a temperature of lower than 950°C.

The following examples are given for the purpose of illustration of this invention and are not intended as limitations thereof.

EXAMPLE 1

A silicon steel strip containing 2.90% of Si, 0.030% of Sb and 0.020% of Se and having a thickness of 0.3 mm, a breadth of 970 mm and a length of 3,200 m was continuously annealed in the atmosphere composed of 70% of $H_2$ and the remainder being $N_2$ and having a dew point of 60°C at 820°C for 4 minutes and coated with MgO and then wound into a coil having an inner diameter of 508 mm. The resulting coil was charged in an electric annealing furnace and the temperature was raised at a rate of 20°C/hour while passing nitrogen gas and the temperature of 850°C was kept for 60 hours and then nitrogen gas was replaced with hydrogen gas and the temperature was again raised to 1,200°C, at which temperature the annealing was continued for 15 hours and then the furnace was cooled.

The thickness of the oxide layer after the continuous annealing was 2.0 $\mu$m, the amount of ignition loss of the coated magnesia was 3.2% and the coated amount was 7.0 per 1 $m^2$ of one surface. The strip surface after cleaning was observed. A deep gray film was formed over the entire length except for the last two turns and the minimum bending radius that the glass film does not exfoliate, was 10 mm and very good. The magnetic properties at the center portion of the longitudinal direction were 1.91 $Wb/m^2$ in $B_8$ value and 1.14 W/Kg in $W_{17/50}$.

EXAMPLE 2

A silicon steel strip containing 2.84% of Si, 0.018% of acid soluble Al and 0.022% of Sb and having a thickness of 0.35 mm, a breadth of 830 mm and a length of 2,800 m was continuously annealed in an atmosphere composed of 60% of $H_2$ and the remainder being $N_2$ and having a dew point of 60°C at 820°C for 4 minutes and coated with magnesia and then wound into a coil having an inner diameter of 508 mm. The resulting coil was annealed in an electric furnace. The atmosphere in the furnace was replaced with $N_2$ gas before raising the temperature and the temperature was raised to 890°C at a rate of 15°C/hour while passing hydrogen gas and then the atmosphere gas replaced with $N_2$ gas and the temperature of 890°C was kept for 80 hours. Then, the nitrogen gas was again replaced with hydrogen gas and the temperature was raised to 1,175° C, at which temperature the annealing was effected for 15 hours and then the thus treated coil was cooled. The thickness of the oxide layer after the continuous annealing was 2.5 $\mu$m and the amount of ignition loss of the coated magnesia was 2.8% and the coated amount was 5.5 g per 1 $m^2$ of one surface. A deep gray film was formed over the entire length of the surface after the high temperature annealing except for the last two turns and the minimum bending radius that the glass film does not exfoliate was 5 mm. The magnetic properties at the center portion of the longitudinal direction of the steel strip were 1.93 $Wb/m^2$ in $B_8$ value and 1.16 W/Kg in $W_{17/50}$.

What is claimed is:

1. In a method for producing a grain-oriented silicon steel sheet having $B_8$ value of more than 1.88 $Wb/m^2$ and provided with a uniform insulating glass film having a high adhesion to a base metal, in which a cold rolled silicon steel sheet having a final gauge is subjected to decarburization annealing under wet hydrogen atmosphere to form an oxide layer consisting mainly of $SiO_2$ and FeO on the surface of the steel sheet, a separator containing MgO is coated on the decarburization annealed steel sheet, the thus treated sheet is wound into a coil and the coiled sheet is heated by keeping the temperature at 800°–920°C constantly for at least 10 hours to fully develop secondary recrystallized grains of (110) [001] orientation and then raising and keeping the temperature at 1,000°–1,200°C constant to form $MgO\text{-}SiO_2$ glass film on the surface of the steel sheet, the improvement which comprises using a neutral gas inert against iron at least in the above described temperature keeping stage of 800°–920° C and replacing the natural gas with hydrogen gas the above described temperature keeping stage of 1,000°–1,200°C.

2. The method as claimed in claim 1, wherein said silicon steel sheet contains 0.005–0.2% of Sb.

3. The method as claimed in claim 1, wherein a thickness of the oxide layer formed by the decarburization annealing is 0.5–4.0 $\mu$m.

4. The method as claimed in claim 1, wherein the neutral atmosphere is used from room temperature to the end of the temperature keeping stage of 800°–920°C.

5. The method as claimed in claim 1, wherein the replacement of the atmosphere from the neutral gas to hydrogen is effected at a temperature of lower than 950°C.

6. The method as claimed in claim 1, wherein said neutral gas is nitrogen containing less than 100 ppm of $0_2$.

* * * * *